United States Patent [19]

Fayren

[11] 4,170,266

[45] Oct. 9, 1979

[54] APPARATUS AND METHOD FOR OFFSHORE DRILLING AT GREAT DEPTHS

[76] Inventor: Jose M. Fayren, Jose Fentanez 19 Pta D Puerta De Hierro, Madrid, Spain, 35

[21] Appl. No.: 823,263

[22] Filed: Aug. 10, 1977

[30] Foreign Application Priority Data

Aug. 11, 1976 [ES] Spain ..... 450.616

[51] Int. Cl.[2] ..... E21B 15/02

[52] U.S. Cl. ..... 175/7; 166/357; 166/366; 405/195

[58] Field of Search ..... 175/7, 5, 8, 9, 10; 166/0.5, 0.6, 366, 362, 357, 350, 358; 405/195, 200

[56] References Cited

U.S. PATENT DOCUMENTS

| | | | |
|---|---|---|---|
| 2,512,783 | 6/1950 | Tucker | 175/8 X |
| 3,015,360 | 1/1962 | Stratton | 175/7 |
| 3,101,798 | 8/1963 | Wilson et al. | 175/8 |
| 3,196,958 | 7/1965 | Travers et al. | 166/0.5 X |
| 3,355,899 | 12/1967 | Koonce et al. | 175/7 |
| 3,472,032 | 10/1969 | Howard | 175/7 |
| 3,626,701 | 12/1971 | Laffont | 175/7 |
| 3,643,446 | 2/1972 | Mott | 175/7 |
| 3,982,401 | 9/1976 | Loggins | 175/7 |
| 4,068,729 | 1/1978 | Peevey | 175/8 |

*Primary Examiner*—Ernest R. Purser
*Assistant Examiner*—Richard E. Favreau
*Attorney, Agent, or Firm*—Wigman & Cohen

[57] ABSTRACT

An offshore drilling installation comprising an underwater base spaced from an underwater buoy and in communication therewith by a connecting conduit. The underwater buoy represents the upward extension of the sea bed which serves to support an above-sea platform. The underwater buoy is further secured to the sea bed by mooring lines. Oil containing means is provided in the underwater base.

18 Claims, 6 Drawing Figures

APPARATUS AND METHOD FOR OFFSHORE DRILLING AT GREAT DEPTHS

BACKGROUND OF THE INVENTION

The present invention relates generally to apparatus and method for offshore drilling and more particularly for drilling at great depths.

The drilling for underwater oil deposits situated at places where the water depth is more than 200 meters (6,560 ft) gives rise to considerable technical and economic problems for which no satisfactory solutions have yet been found.

In shallower depths, the conventional approach is to install framework structure derricks whch are driven into the sea bed. The top part of the derrick is above the surface of the water and serves as a support for a working platform containing the drilling equipment, e.g., equipment for pretreating the oil, well-head maintenance and the like.

However, as the depth of the sea increases, the weight of the support structure increases substantially, as do also the difficulties of constructing and installing the structure. Also, as the depth increases, the hydrostatic pressure at the sea bed makes it very difficult to install the well-head units. At these considerable water depths, the sea bed is practically inaccessible. Thus, it is clear that there exists a need for an offshore drilling operation which is capable of being used economically at great depths.

SUMMARY OF THE INVENTION

In the present invention an underwater base is positioned in the sea bed corresponding to the proposed drilling site. A vertical conduit rising to a zone situated some 50 meters below the level of the water is secured to the base. A tank or "underwater buoy" having a certain positive buoyancy is located at the upper end of the conduit so that the underwater buoy will be situated in a zone in which the forces produced by the waves will be greatly attenuated and can be easily controlled. Also, human access to this underwater buoy will not give rise to any difficulty.

In this manner the sea bed may be considered as being transferred to this underwater buoy. Drilling operations can then be carried out from the surface of the sea by passing the drill through the underwater buoy and a plurality of tubular ducts disposed within the vertical conduit until it penetrates the sea bed. The operating valves and well-head units may be situated in the underwater buoy, which for these purposes represents the sea bed.

The system of this present invention comprises the following components in ascending order:

An underwater base situated on the sea bed and driven into the bed by its own weight;

A vertical underwater conduit starting from the underwater base and rising to a zone of moderate depth;

An underwater buoy situated at the top end of the underwater conduit and having a certain buoyancy; and A top conduit rising from the underwater buoy to above the level of the water above the waves and forming an extension of the underwater conduit.

The system is completed by a radial assembly of mooring lines which fix the underwater buoy to the sea bed by corresponding anchoring means which take-up the horizontal forces produced by waves, currents, etc., and prevent excessive horizontal displacements.

Both the underwater conduit and the top conduit act as a housing for a plurality of conventional tubular ducts through which the drill extends during the drilling operation, such ducts subsequently being used to conduct the oil produced. The conduits may also contain other ducting and piping for handling the oil, ballast, remote-control operations, and the like.

The underwater base is a cellular structure of appreciable weight, the interior of which is formed with empty spaces. Sharp edge projections are provided on the underside of the base for securement purposes. The spaces in the base contain air or some other low-density substance to reduce the apparent specific gravity of the underwater base and to facilitate its handling during the descent of the base to the site of the deposit. Once the base is located on the sea bed, these inner spaces are filled with water to increase the weight of the base so that the sharp-edged structures provided beneath the base are driven into the sea bed to prevent any subsequent shifting of the base. The bottom extension of the underwater conduit is also driven into the bed and penetrates the soft surface stratum to a more consistent stratum where penetration of the drill will take place.

The system described is installed as follows:

The underwater base may be built at a remote location and floated to the site. A floating crane or semi-submersible drilling platform is used to lower the underwater base. The inner spaces thereof are partially flooded until its weight is slightly in excess of its displacement. The base is suspended from the underwater conduit and conduit sections are added as the base descends.

When the underwater base is about 50 meters from the bed, the underwater buoy is added, after having been partially flooded with water. The descent will continue until the base makes contact with the bed, whereupon the spaces inside the underwater base are completely flooded with water or high density fluid to increase its weight and drive the sharp-edged structures provided on its underside into the bed. The previously anchored radial mooring lines are then fixed to the underwater buoy, the top conduit is completed and the plurality of tubular ducts is finally driven into the bed.

If a semi-submersible type platform is then brought into position so that the drill passes along the top conduit and the underwater conduit, the required drilling operations can be carried out in accordance with conventional techniques.

When the wells have been drilled, the oil rises via the tubular ducts to the underwater buoy, from which it is transferred to the ship or appropriate production platform, and the top conduit can be withdrawn.

If a number of operating units as described are installed so that the underwater buoys form the vertices of a polygon, e.g., a rectangle, a non-deformable framework structure can be built on the buoys and emerge from the water and act as a support for a working platform where the production, drilling, oil processing and other equipment are installed. A structure of the framework derrick type will have been constructed for this process but instead of resting it on the sea bed it will rest on floating foundations situated at a shallow depth so that the size of the derrick is drastically reduced. In this case the operating system is self-contained and the aid of a semi-submersible platform to carry out the drilling operations can be dispensed with, and pre-treatment of the oil can also be carried out from the said working platform.

If two or more underwater bases are connected, a large common store is formed comprising a plurality of tanks in which the crude oil produced can be stored. For this purpose free communication is established between the storage tanks and the sea so that the said tanks are not subjected to the external hydrostatic pressure. The tanks are initially water-filled but as the oil production progresses the oil is injected into the tanks and displaces an equal volume of water which is discharged to the sea via the underwater conduit, which communicates with the sea and also with the bottom part of the storage tanks. In this way oil and water are present in the tanks at separate levels and are separated solely by their density difference.

In another variant, two or more underwater buoys may be interconnected to form larger buoys which can form the sides of the above-mentioned polygon or the complete polygon.

The working platform may comprise a floating hull inside which the oil treatment equipment, accommodation, etc., are provided. In this form it can readily be prefabricated in a conventional shipyard and be towed afloat to its site. Any lifting means can be used to finally raise it above the level of the water where it remains supported on the top conducts of the aforementioned framework structure.

In very large and extensive deposits, an operating complex can be established by installing a central unit formed by a self-contained production platform mounted on a polygon of underwater buoys and a group of individual satellite units, the production of which is transferred to the central unit.

BRIEF DESCRIPTION OF THE DRAWINGS

All the above features will be readily understood from the following brief description of the accompanying drawings, which diagrammatically show one preferred embodiment given by way of example. The same reference numerals are used to depict the same element throughout the several views.

DETAILED DESCRIPTION OF A PREFERRED EMBODIMENT

Figure 1:
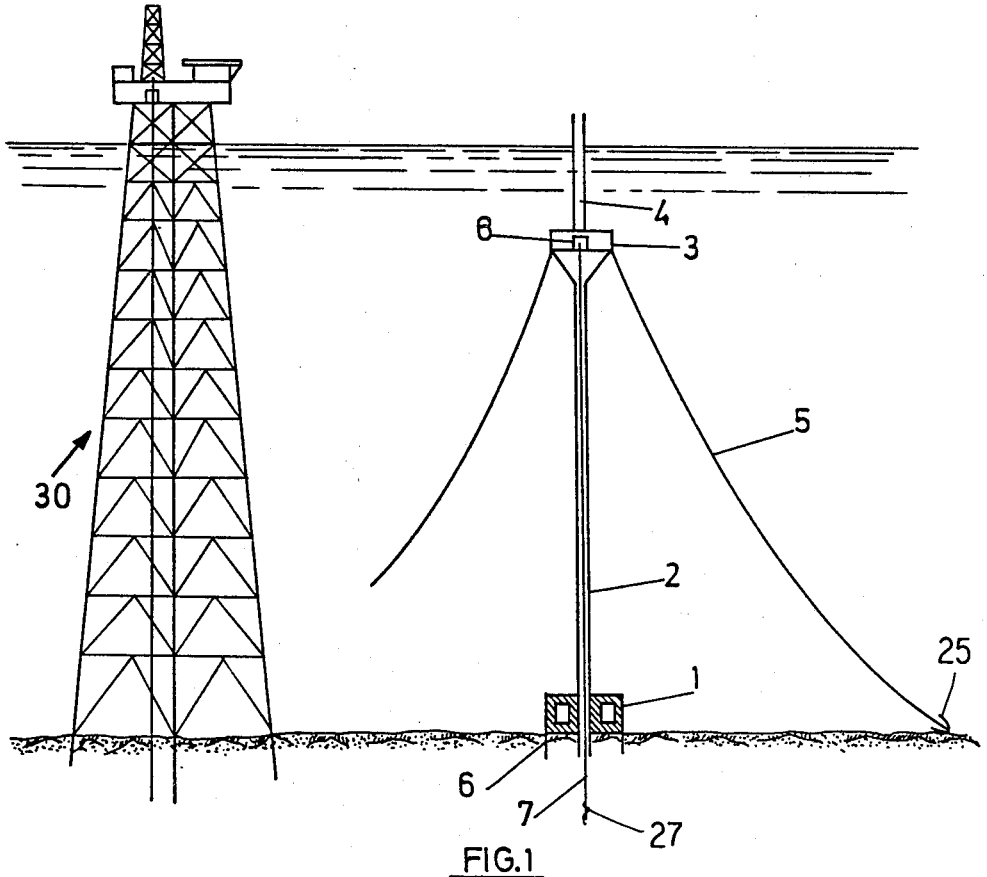
FIG. 1 is a front elevation of a single operating unit built in accordance with the present invention and a conventional framework structure located to the left thereof.

Referring to FIG. 1, the operating unit according to the present invention comprises an underwater base 1, an underwater conduit 2, an underwater buoy 3, a top conduit 4 and mooring lines 5. The mooring lines 5 have anchors 25 for securing the lines 5 to the sea bed. Sharp-edged structures 6 are provided beneath the base and are driven into the bed. The underwater base is a very heavy cellular structure, the interior of which is formed with empty spaces. A group of tubular ducts 7 is accommodated inside the underwater conduit 2 and is driven into the bed by its bottom end 24 while operating valves 19 and well-head control units 8 housed inside the underwater buoy 3 are provided at the top end.

For comparison purposes there is also shown in FIG. 1 a conventional framework structure—identified with reference numeral 30—whose construction and installation are much more complicated and expensive than the operating unit according to the present invention. Such structures are practically impossible to construct at great sea bed depths, e.g., 300 meters.

Figure 2:
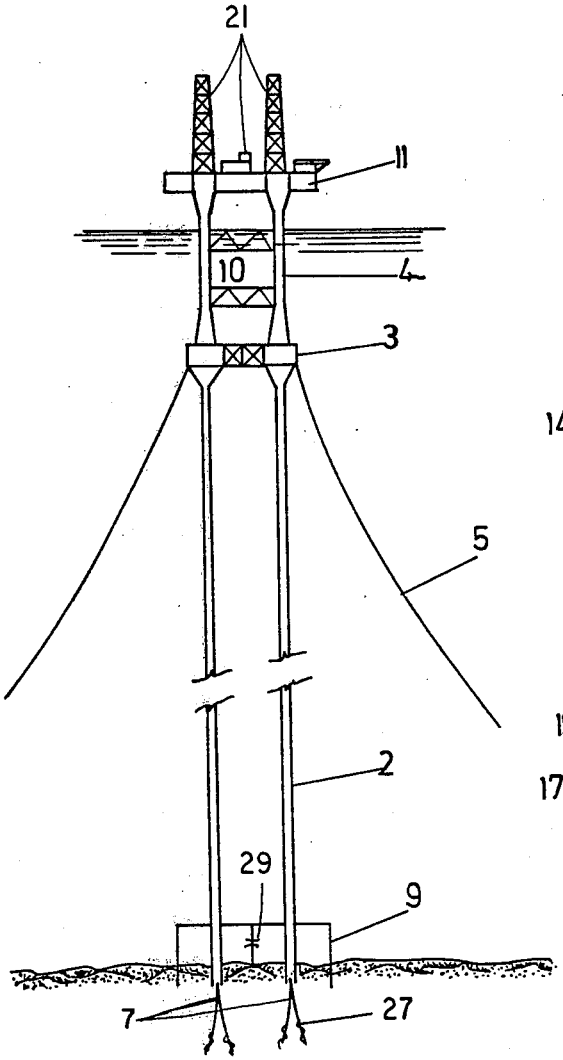
FIG. 2 is a front elevation of a production platform supported on four operating units of the type shown in FIG. 1.
Figure 5:
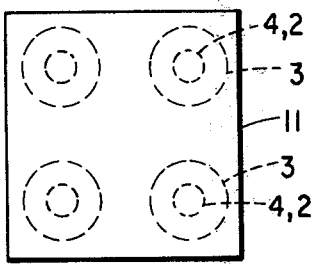
FIG. 5 is a top plan view of FIG. 3 and schematically represents the polygonal arrangement of the underwater buoys forming a part of the present invention.
Figure 3:
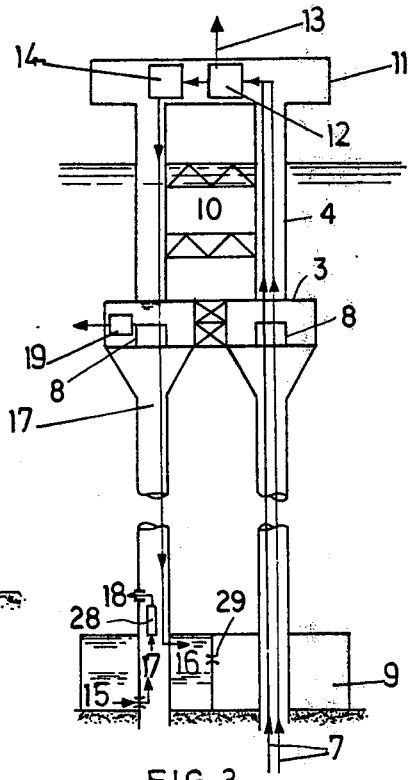
FIG. 3 is a schematic representation showing the flow paths of the liquids employed in the system of the present invention.

FIG. 2 shows a production platform constructed on four operating units each of which is similar to the operating unit shown in FIG. 1. For purposes of clarity only two units are illustrated. In FIGS. 2 and 3 it will be seen that the underwater bases have been interconnected by intercommunication means 29 to form a single and larger base 9, which is to be used for storing the crude oil produced. The underwater buoys 3 and the top conduits 4 have been interconnected by means of an assembly of trusses to form a three-dimensional framework structure. This structure constitutes a non-deformable spatial assembly 10 which rests on the four underwater buoys 3. Each buoy 3 forms the vertex of a polygonal arrangement shown in FIG. 5. Unlike other floating platform types, the stability of the assembly 10 is not obtained by means of a metacentric height provided by the flotation areas of the top conduits 4, since the latter may be very thin, but the fact that the buoys 3 remain in a fixed relative position within a horizontal plane. The buoy assembly 3 therefore constitutes a foundation similar to that which the sea bed could offer and is also stronger, because the buoyancy capacity of each of the buoys is equivalent to its ascensional force, which can be very much greater than the buoyancy capacity of a sea bed formed by soft strata.

The drilling of wells in conventional form can be carried out from the working platform 11 to give an independent operating system, it being possible to dispense with the aid of a semi-submersible platform to carry out the drilling work.

FIG. 3 schematically shows the path taken by the oil produced and stored. The recovered crude oil enters at the bottom and rises via a plurality of vertical conduits represented by the solid line 7 with arrows thereon to the working platform 11, and into the gas separator 12 where the gases 13 are separated from the liquid oil. Liquid oil is passed through other treatment units 14 until it is finally pumped to the storage tanks 15 of the underwater base 9. These underwater tanks 15 are initially filled with sea-water via orifices 18. When the oil arrives from treatment units 14 and occupies the upper part 16 of the tanks 15, the water is forced to the interior 17 of the underwater conduits and out to sea via orifices 18 situated in the lower part of the conduits. Thus, the tanks 15 of the underwater base 9 are not subjected to external hydrostatic pressure since the tanks 15 are in permanent communication with the interior 17 of the underwater conduits 2, and hence with the sea, via orifices 18. The water leaving via the orifices 18 may contain impurities from being in contact with the oil 16, however, this water is not directly discharged into the sea but passes through conventional purification units 28 which monitor impurities by sensing the presence of oil in water in the space 17.

When the stored oil is transferred to a ship from the underwater tanks, the direction of flow is reversed. The oil is drawn from the tank spaces 16, and this causes seawater to enter the tank 15 via interior 17 and the orifices 18.

Figure 4:
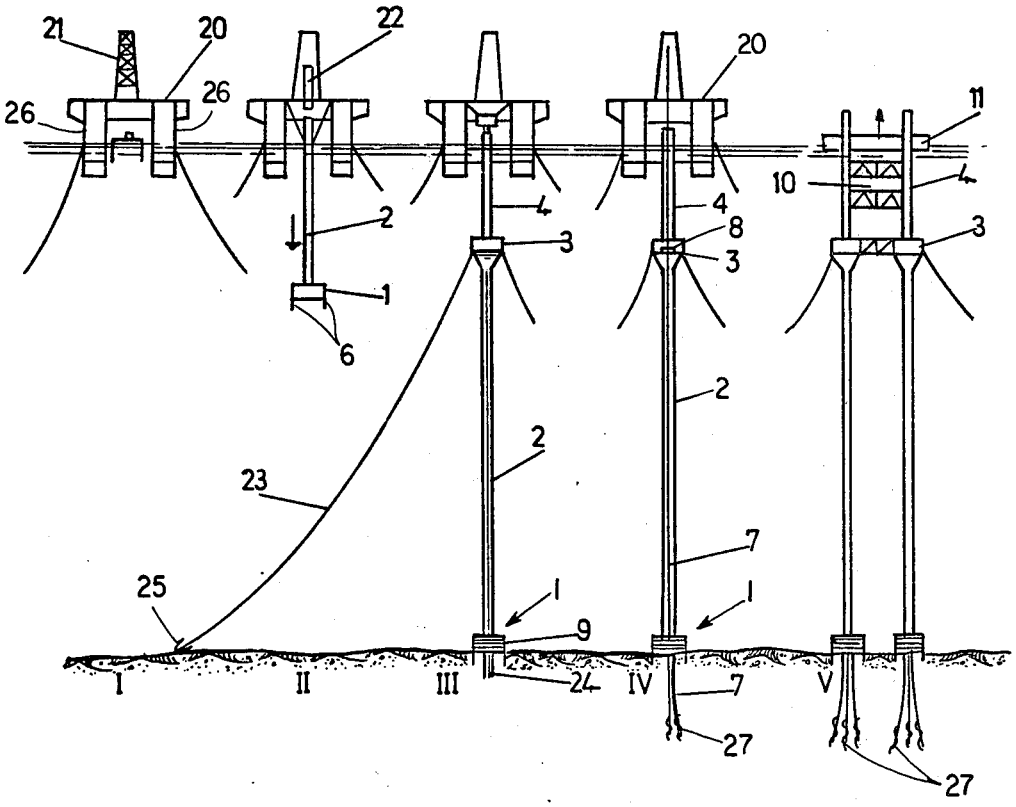
FIG. 4 diagrammatically illustrates the sequence of erecting the main stages of a production platform in accordance with the present invention.

FIG. 4 shows the main stages of the construction process. Stage I shows a semi-submersible platform 20 moored at the site of the deposit. The underwater base 1 which is prefabricated is floated to a position between the pillars 26 of the semi-submersible platform beneath the drilling derrick and other production equipment 21.

When the spaces inside 1 have been partially flooded until its weight is slightly greater than its displacement, the base 1 is suspended by means of the underwater conduit 2 and conduit sections 22 are added as the base descends, as shown in Stage II.

Once the underwater conduit 2 is completed and the partially water-filled underwater buoy 3 has been added, the descent is continued until the base 1 makes contact with the bed (stage III). The inner spaces 9 of the underwater base 1 are then selectively flooded to increase its weight and to secure the base to the bed by means of the sharp-edged projections 6 (best seen in FIG. 1) provided on the underside of base 1. Radial mooring lines 23 previously anchored to the bed are then fixed and the top conduit 4 is completed. A plurality of tubular ducts 7 extending along the underwater conduit 2 is finally driven into the sea bed. The bottom end 24 of the group of tubular discs 7 penetrates the soft surface stratum to a more consistent stratum as may be seen in stage III of FIG. 4.

The directional drilling operations are carried out from the semi-submersible platform 20 in stage IV, the drill being passed through the top conduit 4, the buoy 3, the underwater conduit 2, and the base 1, the drill 27 being housed in the appropriate tubular duct 7, until it penetrates the bed.

Depending on the size of the deposit, an operating platform 11 can be installed above a group of buoys 3 as shown in stage V. It has been assumed that various operating units of the type represented hereinabove have been installed. The buoys 3 and the top conduits 4 are interconnected by means of trusses put into position by means of a floating crane. This gives a non-deformable spatial structure 10 which rests on the assembly of underwater buoys 3.

The working platform 11 is independently prefabricated as a floating hull 11 and contains the drilling derrick and other production equipment 21. Hull 11 is towed afloat and is located between the top conduits 4. Finally hull 11 is lifted, by lifting means, above the sea level and fixed in its final position resting on the top conduits 4.

Figure 6:
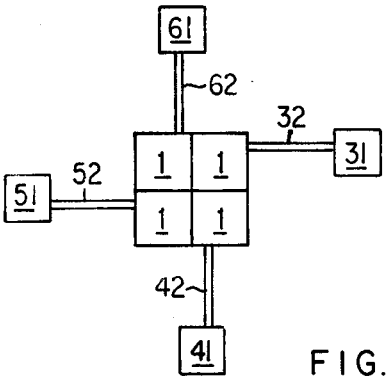
FIG. 6 is a schematic top plan view of a group of independent units operating in the system of the present invention.

FIG. 6 shows a group of individual satellite units, the production of which is transferred to the central unit 1. A plurality of independent underwater bases 31, 41, 51, and 61 are disposed near a group of interconnected underwater bases 1. Pipeline means 32, 42, 52, and 62 transfer production to the assembly formed by the underwater bases 1 on whose underwater buoys 3 support the spatial framework structure 10.

The nature of the invention, and the way in which it may be put into effect, having been sufficiently described, it should be noted that the above-described features may be modified as to detail without departing from the scope of the invention.

What is claimed:

1. An installation for the exploitation of underwater oil or other hydrocarbon deposits, especially deposits located in deep water, comprising:

an underwater base disposed on a sea bed;

sharp-edged projection means, located at the underside of said underwater base, for fixing said underwater base on said sea bed; a lower circuit means, accommodating therein a plurality of tubular ducts projecting upwardly from said underwater base to a moderate depth, for reducing the wave action effect at the surface;

an underwater buoy situated at the top end of the lower conduit means and having a certain buoyancy;

an upper conduit which projects upwardly from said underwater buoy to about the level of the sea or thereabove; and mooring means for securing said underwater buoy to the sea bed and for maintaining said lower conduit means in substantially vertical orientation, said lower conduit means having a bottom portion extending through said underwater base and being affixed directly into said sea bed, said underwater buoy including well-head control means for drilling into said sea bed.

2. An installation according to claim 1 wherein said mooring means comprises a radial assembly of mooring lines having anchoring means for securing said lines to said sea bed.

3. An installation according to claim 1, further comprising a plurality of tubular ducts extending through said lower conduit means and drill means extending through said tubular ducts during drilling operations.

4. An installation according to claim 1, wherein a wall of the lower conduit means includes orifices through which the interior of said lower conduit means is in fluid communication with sea water.

5. An installation according to claim 1, wherein said underwater buoy is of sufficient size to house at least one well-head unit by which drilling operations can be carried out from the surface of the sea.

6. An installation according to claim 1, wherein:

said underwater base includes chambers in a prefabricated cellular structure which is floatable to the point where the underwater base is to be submerged, a semi-submersible platform is positioned above said underwater base when assembled, orifice means, arranged in the lower conduit means, for partially filling said chambers in the cellular structure of the underwater base so that the weight of the underwater base slightly exceeds its displacement, said underwater base being suspended by said lower conduit means, and drilling means extend through said plurality of tubular ducts for penetrating said sea bed at a drilling site.

7. An installation according to claim 1, wherein said underwater base comprises a cellular structure having internal chambers, the total volume of said chambers being such that, when said chambers are empty or are filled with a low-density substance, the cellular structure can float in sea water and, when said chambers are filled with water or a high-density fluid, the cellular structure can submerge to drive the sharp-edged projection means into the sea bed.

8. An installation according to claim 7, wherein said internal chambers are formed with at least one orifice which communicates with the exterior thereof into an interior of the lower conduit means.

9. An installation according to claim 7, wherein the internal chambers of a plurality of the underwater bases include means for intercommunicating with one another, said internal chambers being in communication with the sea, thereby eliminating external hydrostatic pressure.

10. An installation according to claim 9, wherein:

said plurality of tubular ducts carries oil to a working platform, said working platform includes separating means and treating means, said internal chambers of the plurality of the underwater bases include storage tanks to which said oil is pumped and wherein said oil displaces water to occupy a top part of an interior of said storage tanks, said interior of the storage tanks being in communication with the sea via orifices formed in the bottom part of said storage tanks, and said lower conduit means includes monitoring means for sensing the presence of oil in water in spaces inside said lower conduit means.

11. An installation according to claim 1, further comprising:

a first plurality of underwater bases disposed near one another, a corresponding plurality of lower conduit means and underwater buoys, said plurality of underwater buoys forming the vertices of a polygon, a non-deformable spatial framework including a plurality of the upper conduits supported on said underwater buoys and emerging from the water to support a working platform, whereby said spatial framework rests on a floating foundation formed of said underwater buoys and situated at an effectively reduced depth so that the stability of the spatial framework and the working platform is provided by said underwater buoys.

12. An installation according to claim 11, further comprising:

a second plurality of independent satellite underwater bases disposed near the first plurality of underwater bases, and means for transferring production to the assembly formed by the first plurality of underwater bases on whose underwater buoys said spatial framework is supported.

13. An installation according to claim 11, wherein:

said working platform is constructed in the form of a prefabricated floating hull containing production equipment positioned between pillars of the spatial framework and secured thereto.

14. A method of offshore drilling for hydrocarbons comprising the steps of:

floating a cellular base having sharp-edged projections on its bottom;

positioning said base at a drilling location between pillars of a semi-submersible platform previously moored at said drilling location;

partially flooding chambers of the base so that its weight slightly exceeds its displacement;

submerging said base;

adding sections of lower conduit to said base as it descends;

attaching a partially water-filled underwater buoy to said lower conduit;

adding additional conduit to continue the descent until said base makes contact with a sea bed;

selectively flooding said base to increase the weight of said base in order to drive the sharp-edged projections on the bottom of the base into the sea bed, thereby securing said base to said sea bed;

driving a bottom extension of said lower conduit into said sea bed thereby forming a continuous path from said platform to the sea bed; and drilling into said sea bed from said platform.

15. The improvement according to claim 14, further comprising the steps of:

attaching mooring lines to the underwater buoy; and anchoring said mooring lines to the sea bed.

16. In an installation for offshore drilling of underwater hydrocarbon deposits located at great depths of water, which includes an underwater base disposed on a sea bed; a lower underwater conduit projecting upwardly from the base to a zone of moderate depth; an underwater buoy situated at a top end of the lower underwater conduit; an upper underwater conduit which projects upwardly from said underwater buoy to about the level of the sea or thereabove; a radial assembly of mooring lines for securing said underwater buoy to the sea bed; wherein the improvement comprises:

said underwater base being of cellular construction of appreciable weight, an interior of which is formed with empty spaces;

sharp-edged projections being provided on the underside of the base for securement purposes;

orifice means, being provided at a lower part of the lower underwater conduit, for filling empty space in the base with high density fluid to increase its weight so that the sharp-edged projections on the underside of the base and a bottom extension of the lower underwater conduit are driven into the sea bed; and said lower underwater conduit being integral with the underwater buoy to prevent horizontal movements caused by waves and currents between the underwater conduit and the underwater buoy.

17. The improvement according to claim 16, wherein:

said underwater buoy is constructed to house operating valves and at least one well-head unit;

said lower underwater conduit includes a plurality of tubular ducts disposed therein; and said tubular ducts penetrating the sea bed so that drilling operations can be carried out from a semi-submersible type platform by passing a drill through said at least one well-head unit located at the underwater buoy and through the tubular ducts disposed within the lower underwater conduit.

18. The improvement according to claim 16, wherein the cellular construction of the underwater base stores produced crude oil in storage tanks, said storage tanks being in fluid communication with the sea so that said cellular construction is not subjected to external hydrostatic pressure;

said storage tanks being initially filled with water but, as production of oil progresses, the oil is injected into the storage tanks and displaces the water which is discharged to the sea via the lower underwater conduit, which communicates with the sea and also with a bottom part of the storage tanks.

* * * * *

UNITED STATES PATENT AND TRADEMARK OFFICE

CERTIFICATE OF CORRECTION

PATENT NO. : 4,170,266

DATED : October 9, 1979

INVENTOR(S) : Jose M. FAYREN

It is certified that error appears in the above-identified patent and that said Letters Patent are hereby corrected as shown below:

Column 6, Claim 1, line 7, please change "circuit" to --conduit--.

Signed and Sealed this

*Fifteenth* Day of *January 1980*

[SEAL]

*Attest:*

*Attesting Officer*

SIDNEY A. DIAMOND

*Commissioner of Patents and Trademarks*